United States Patent [19]

Gräther et al.

[11] 4,162,665

[45] Jul. 31, 1979

[54] MULTI-SPARK IGNITION SYSTEM FOR INTERNAL COMBUSTION ENGINES

[75] Inventors: Günter Gräther, Pinache; Friedrich Rabus, Schwieberdingen, both of Fed. Rep. of Germany

[73] Assignee: Robert Bosch GmbH, Stuttgart, Fed. Rep. of Germany

[21] Appl. No.: 799,247

[22] Filed: May 23, 1977

[30] Foreign Application Priority Data

May 28, 1976 [DE] Fed. Rep. of Germany ..... 2623864

[51] Int. Cl.[2] ..... F02P 3/02

[52] U.S. Cl. ..... 123/117 R; 123/148 DS

[58] Field of Search ..... 123/117 R, 148 CB, 148 DS

[56] References Cited

U.S. PATENT DOCUMENTS

| | | | |
|---|---|---|---|
| 2,940,014 | 6/1960 | Legay et al. | 123/148 CB |
| 3,280,809 | 10/1966 | Issler | 123/148 CB |
| 3,489,129 | 11/1970 | Issler et al. | 123/148 CB |
| 3,520,288 | 7/1970 | Dusenberry et al. | 123/148 CB |
| 3,596,133 | 7/1971 | Warren | 123/148 CB |
| 3,599,617 | 8/1971 | Warren | 123/148 CB |
| 3,660,689 | 5/1972 | Oishi et al. | 123/117 R |
| 3,757,519 | 9/1973 | Graewert | 123/117 R |
| 3,853,103 | 12/1974 | Wahl et al. | 123/117 R |
| 3,854,465 | 12/1974 | Adams | 123/117 R |
| 3,926,165 | 12/1975 | Merrick | 123/148 CB |

*Primary Examiner*—Verlin R. Pendegrass
*Assistant Examiner*—S. A. Cangialosi
*Attorney, Agent, or Firm*—Frishauf, Holtz, Goodman, Woodward

[57] ABSTRACT

To generate a plurality of spark pulses for a multi-spark breakdown for each ignition event for ignition of a combustible mixture in an internal combustion engine, while providing for positive generation of the first spark at a predetermined time instant, a time delay circuit is connected to control a frequency generator for generation of a plurality of spark pulses, the first spark pulse, however, being controlled through a differentiating network, for example an R/C network, for positive generation of the first pulse.

11 Claims, 2 Drawing Figures

MULTI-SPARK IGNITION SYSTEM FOR INTERNAL COMBUSTION ENGINES

Reference to prior applications and patents:
U.S. Pat. No.:
3,926,557
3,791,364
3,779,226
3,636,936
3,626,910
3,593,696
3,489,129
German app. (DT-OS 2340865).

The present invention relates to a system to initiate spark ignition, and particularly an ignition system for internal combustion engines in which each ignition event is characterized by repeated breakdown of the spark gap, that is, by the generation of a sequence of spark pulses for each ignition event.

BACKGROUND AND PRIOR ART

One form of an ignition system utilizes an ignition coil in which magnetic energy is stored. If the repetition frequency of the spark sequence is such that the stored magnetic energy is not completely dissipated at each breakdown of the spark gap, then only a shorter period of time is necessary for a subsequent pulse through the primary of the ignition coil in order to re-establish the required magnetic energy in the ignition coil itself. The first charge pulse, however, should be of sufficient length and intensity to completely store all the charge energy in the ignition coil which it is capable of holding.

It has previously been proposed, see, for example U.S. Pat. No. 3,926,557, to provide an ignition system in which repetitive spark pulses are generated by using a frequency generator which, repetitively, closes a control switch to permit current to flow through the primary of the ignition coil. If the frequency of operation of the frequency generator is high, then the exact timing of triggering of the first spark or breakdown of the spark plug cannot be reliably determined; if it is too low, then the number of breakdowns of the spark gap may be undesirably low.

SUBJECT MATTER OF THE PRESENT INVENTION

Briefly, and in order to provide reliable timing of the first breakdown of the spark gap, that is, of the first spark pulse, with still high repetition rate of the frequency generator, and thus a high number of spark pulses, a spark generation control circuit, e.g., differentiating circuit, typically an R/C network, is connected between the triggering circuit and the controlled switch which determines the generation of a pulse causing breakdown of the spark gap. Preferably, this circuit provides a pulse in the nature of a sawtooth wave, the decay rate of which determines the length during which ignition energy can be stored in a spark coil. Connected in parallel to this circuit is a series circuit formed of a time delay circuit and the frequency generator, the time delay circuit delaying starting of application of pulses from the frequency generator to the controlled switch and providing for the subsequent repetitively occurring control pulses to effect repetitive breakdown of the spark gap.

The system has the advantage that the frequency of the frequency generator can be selected to be high since the ignition coil will store energy of sufficient level that a large number of breakdown pulses can be applied to the spark plug for any one ignition event. Yet, the slow-decay differentiating circuit, which controls initial storage of electromagnetic energy typically the R/C network, provides, initially, a sufficiently large charge duration to the ignition coil to store magnetic energy therein in order to provide the first breakdown with reliability and efficiency.

Drawings, illustrating an example:

Figure 1:
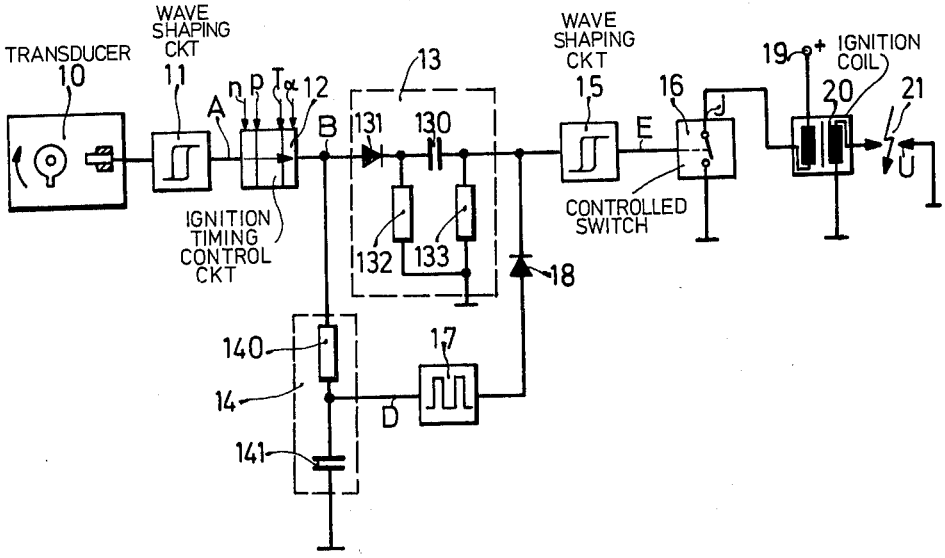
FIG. 1 shows a circuit diagram illustrating an example of the invention.

The invention will be described and illustrated in connection with an electronically controlled ignition system for an internal combustion engine, although other systems may be used.

A non-contacting trigger system 10, coupled to the crankshaft of an internal combustion engine (not shown), is connected to a wave-shaping circuit 11, preferably a Schmitt trigger, to provide square wave output pulses from the pulses generated in system 10. The system 10 is shown as an inductive transducer; it may, however, also be a breaker-type contact customary in connection with a distributor, a Hall generator, or the like. The output of the wave shaping stage 11 is connected through an ignition timing control network 12 to a further wave-shaping stage 15 which, preferably, also is a Schmitt trigger. The ignition timing control circuit 12 changes the ignition instant in dependence on engine operation or operating parameters, for example engine speed n, induction pipe vacuum p, temperature T or throttle deflection angle $\alpha$. Such circuits are known and need not be described. They may, additionally, include provisions to introduce other operating or operation data to change the ignition instant, for example composition of exhaust gases. In simple ignition systems it is possible to omit the ignition timing control circuit 12.

The ignition timing control circuit 12 is connected to circuit stage 13 which has R/C function and then to a Schmitt trigger 15. Stage 13, preferably is an R/C network. Schmitt trigger 15 is connected to the control input of an electronic switch 16, preferably a controlled semiconductor such as a transistor. A time delay circuit 14 is likewise connected to the output of ignition timing control circuit 12 and, in turn, controls a frequency generator 17 which is coupled through a decoupling diode 18 to the input of the Schmitt trigger wave shaping stage 15. A terminal 19, connected to the positive terminal of a supply source supplies electrical current to the primary of an ignition coil 20 which is additionally connected in series with a switching path of the controlled switch 16. The secondary of ignition coil 20 is connected between ground or chassis, or a reference potential, and one terminal of a spark gap 21, the second terminal of which is likewise connected to ground or chassis. When applied to internal combustion engines, the spark gap 20 is typically a spark plug. For multi-cylinder engines, a distributor can be interposed between the ignition coil and a group of spark plugs.

The R/C circuit stage 13 is formed by a capacitor 130, series connected to the output of ignition timing circuit 12 through a decoupling diode 131. The two terminals of the capacitor 130 are each connected to ground or chassis through respective resistors 132, 133.

The timing circuit 14 is formed as a series circuit of a charge resistor 140 and a capacitor 141, the second terminal of which is grounded. The junction between the charge resistor 140 and capacitor 141 is connected to an input of the frequency generator 17 which controls application of output pulses through a decoupling diode 18 to the wave shaping circuit 15.

If it is desired to provide for voltage blocking or accumulation at the secondary, then a high voltage diode should be connected between the secondary winding of ignition coil 20 and spark gap 21 (see, for example, application Ser. 776,735 filed Mar. 11, 1977, Grather et al., assigned to the assignee of the present application).

Figure 2:
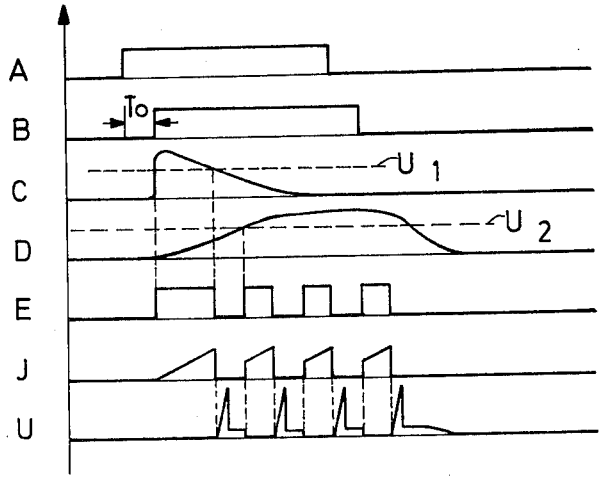
FIG. 2 shows a series of timing graphs of signals occurring in the network of FIG. 1.

Operation, with reference to FIG. 2: A signal from transducer 10 is transformed into a square wave signal as shown in graph A of FIG. 2 in the wave shaping stage 11. The ignition timing control circuit 12 delays this signal for a predetermined time $T_o$ resulting in the signal shown in graph B, which controls the ignition event to be generated under control of transducer 10. The signal of graph B is available at the inputs of both the R/C stage 13 as well as at the input to the time delay circuit 14. The output of the R/C circuit stage 13 will have a wave shape as shown in graph C. As can be seen, this graph is similar to a differentiated curve with a long delay, or to a sawtooth wave. As seen in FIG. 2, the voltage rises rapidly and then decays slowly, as determined by the discharge of capacitor 130 through the resistors 132, 133.

The time delay circuit 14 will generate a signal as seen in graph D. At first, upon initiation of the signal D, the voltage of the signal of D will rise slowly, determined by the charge duration of capacitor 141 through the charge resistor 140. Upon termination of the signal B, the capacitor 141 will discharge through the input resistance of the frequency generator 17 as well as through the resistor 140, so that the voltage D will decay. Different discharge circuits can be provided as desired.

When the voltage C rises above a certain threshold value indicated as U1 of the input of the wave shaping stage 15, then an output signal as shown in graph E will appear thereat. Termination of this signal is controlled by the decay of the voltage C, that is, when the voltage C drops below the threshold level U1. The wave shaping stage 15 may have an upper and a lower threshold value so that different threshold levels are provided for a rising or for a decaying wave. When the voltage D first reaches the threshold level U2 for initiation of application of pulses from the frequency generator 17, then its output will provide a sequence of pulses which, preferably, is a train of square waves. This pulse train is applied as the pulse sequence E to the output of the wave shaping stage 15 without any modification therein so long as signal D is above the threshold level of stage 15, that is, is above U2.

The signals E control the electrical switch 16 to repetitively open and close to cause a current I to flow through a primary winding of ignition coil 20. The electrical switch 16 will open upon termination of any pulse E. The result will be ignition pulses shown in graph U of FIG. 2 causing, each time, breakdown of the spark gap 21. If gaps between the signals E are selected to be short, then the magnetic energy stored in the ignition coil will not completely decay or drop to zero level. Thus, upon each subsequent closing of the switch 16, current will first rise rapidly and then more slowly during the duration of the signal E, as shown in the graph J of FIG. 2. The first signal E is generated, however, by initial spark control network, i.e., the R/C network 13 which has a longer time duration than the signals controlled or commanded by frequency generator 17 since, upon initiation of the train of pulses, the ignition coil will not have stored therein ignition energy from a preceding pulse of a spark train, and current rise will start from zero level. Circuit 13 thus has a dual function: to control the initial storage of electromagnetic energy by controlling the flow of current through coil 19 by controlling the closing time of switch 16; and then to determine the ignition instant of the first spark gap breakdown by controlling subsequent opening of switch 16.

The length of the spark train as shown in graph U is determined, essentially, by the length of signals A or B, respectively, that is, by the output voltage wave shape of the transducer 10. If the length of the spark gap is not to be determined by the width of the signal derived from the transducer 10, then the stage 11 or 12 may additionally include a timing circuit, the time duration of which determines the length of the spark train or spark band width.

The R/C circuit stage 13, or the time delay circuit 14, can be replaced by different types of circuit elements which have an equivalent function.

In a typical example of a system designed for a four-cylinder internal combustion engine and operating with a 12 V battery voltage at terminal 19, the following parameters and circuit values were found to be suitable:

length of signal B: 4 ms
capacitor 130: 10 nF
resistor 132: 100 kΩ
resistor 133: 30 kΩ
capacitor 141: 10 nF
resistor 140: 20 kΩ
pulse repetition rate of frequency generator 17: 4 kHz
These circuit parameters resulted in 16 output pulses at an engine speed of 2000 r.p.m.

Various changes and modifications may be made within the scope of the inventive concept.

We claim:

1. In a sequential multiple spark pulse ignition system having an ignition coil (20) and at least one spark gap (21) connected to the secondary of the coil (20);

a controlled switch (16) connected to the primary of the coil and controlling current flow therethrough;

means (10, 11, 12) furnishing a signal (B) controlling generation of an ignition event;

and means to separately control the closing and opening of said controlled switch (16) for generation of the first spark pulse of said sequential multiple spark pulses and the next subsequent spark pulses comprising a circuit stage (13) including a R/C function network connected to and controlling said controlled switch (16) to control supply of current to the coil to store energy for a first spark pulse;

a frequency generator (17) controlling repetitive opening and closing of the controlled switch (16) for an ignition event to generate said sequential spark pulses upon opening, after prior closing, of said controlled switch;

and a time delay circuit (14), serially connected to the frequency generator (17), the series circuit formed by the time delay circuit (14) and the frequency generator (17) being connected in parallel to the circuit stage (13), said circuit stage (13) providing a control pulse to the controlled switch (16) upon sensing an ignition event signal from said signal furnishing means (10, 11, 12) and said time delay circuit initiating a timing interval and after elapse thereof, controlling application of pulses from the frequency generator to the controlled switch (16).

2. System according to claim 1, wherein the differentiating circuit (13) has a long decay time to provide for a first pulse to the controlled switch of extended duration.

3. System according to claim 1, wherein the circuit stage (13) provides an output pulse having the characteristics of an extended sawtooth wave to provide a first pulse to the controlled switch (16) of extended duration.

4. System according to claim 1, wherein the differentiating circuit (13) is an R/C circuit.

5. System according to claim 1, further comprising a wave shaping stage (15) connected in advance of the controlled switch (16).

6. System according to claim 5, wherein the circuit stage (13) is an R/C circuit.

7. System according to claim 7, wherein the wave shaping stage (15) is a Schmitt trigger.

8. System according to claim 1, wherein the circuit stage (13) has a storage time constant which is long with respect to the pulses from the pulse generator (17) to provide for a first pulse to the controlled switch (16) of extended duration.

9. System according to claim 1, wherein the circuit stage (13) comprises a differentiating circuit.

10. System according to claim 8, wherein the wave shaping stage senses voltage levels upon rise and fall of said first pulse provided by the electromagnetic energy storage control circuit.

11. System according to claim 8, wherein the circuit stage (13) is an R/C circuit having a long time constant, and the wave shaping stage (15) senses voltage levels upon rise and fall of the first pulse provided by the R/C circuit.

* * * * *